US007427340B2

(12) United States Patent
Mavliev et al.

(10) Patent No.: US 7,427,340 B2
(45) Date of Patent: Sep. 23, 2008

(54) CONDUCTIVE PAD

(75) Inventors: Rashid A. Mavliev, Campbell, CA (US); Ralph M. Wadensweiler, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 526 days.

(21) Appl. No.: 11/102,557

(22) Filed: Apr. 8, 2005

(65) Prior Publication Data

US 2006/0229007 A1 Oct. 12, 2006

(51) Int. Cl.
*C25B 9/12* (2006.01)

(52) U.S. Cl. ..... 204/279; 204/224 M; 204/224 R; 451/533; 451/534; 451/539

(58) Field of Classification Search ..... 204/279, 204/224 M, 224 R; 451/533, 534, 539; 205/653, 205/662, 663
See application file for complete search history.

(56) References Cited

U.S. PATENT DOCUMENTS

| | | | |
|---|---|---|---|
| 1,601,642 | A | 9/1926 | Parker |
| 1,927,162 | A | 9/1933 | Fiedler et al. |
| 2,112,691 | A | 3/1938 | Crowder |
| 2,240,265 | A | 4/1941 | Nachtman |
| 2,392,687 | A | 1/1946 | Nachtman |
| 2,431,065 | A | 11/1947 | Miller |
| 2,451,341 | A | 10/1948 | Jernstedt |
| 2,453,481 | A | 11/1948 | Wilson |
| 2,454,935 | A | 11/1948 | Miller |
| 2,456,185 | A | 12/1948 | Grube |
| 2,457,510 | A | 12/1948 | van Omum |
| 2,458,676 | A | 1/1949 | Brenner et al. |
| 2,461,556 | A | 2/1949 | Lorig |
| 2,473,290 | A | 6/1949 | Millard |
| 2,477,808 | A | 8/1949 | Jones |
| 2,479,323 | A | 8/1949 | Davis |
| 2,480,022 | A | 8/1949 | Hogaboom |
| 2,490,055 | A | 12/1949 | Hoff |
| 2,495,695 | A | 1/1950 | Camin et al. |
| 2,500,205 | A | 3/1950 | Schaefer |

(Continued)

FOREIGN PATENT DOCUMENTS

| | | |
|---|---|---|
| EP | 0 325 753 | 8/1989 |

(Continued)

OTHER PUBLICATIONS

EP Search Report for Application No. 03254807.5 dated Sep. 27, 2005.

(Continued)

*Primary Examiner*—Bruce F Bell
(74) *Attorney, Agent, or Firm*—Patterson & Sheridan

(57) ABSTRACT

A method and apparatus for a processing pad assembly for polishing a substrate is disclosed. The processing pad assembly has a conductive processing pad having a plurality of raised features made of a conductive composite disposed on a conductive carrier. The raised features are adapted to polish the feature surface of a substrate and define channels therebetween. The conductive processing pad may have lower features made of a conductive composite that extend into the sub-pad from the conductive carrier. The conductive processing pad is adhered to a sub-pad bound to an opposing conductive layer and the opposing conductive layer bound to a platen assembly.

17 Claims, 7 Drawing Sheets

U.S. PATENT DOCUMENTS

| | | | |
|---|---|---|---|
| 2,500,206 | A | 3/1950 | Schaefer et al. |
| 2,503,863 | A | 4/1950 | Bart |
| 2,506,794 | A | 5/1950 | Kennedy et al. |
| 2,509,304 | A | 5/1950 | Klein |
| 2,512,328 | A | 6/1950 | Hays |
| 2,517,907 | A | 8/1950 | Mikulas |
| 2,519,945 | A | 8/1950 | Twele et al. |
| 2,530,677 | A | 11/1950 | Berkenkotter et al. |
| 2,535,966 | A | 12/1950 | Teplitz |
| 2,536,912 | A | 1/1951 | Cobertt |
| 2,539,898 | A | 1/1951 | Davis |
| 2,540,175 | A | 2/1951 | Rosenqvist |
| 2,544,510 | A | 3/1951 | Prahl |
| 2,549,678 | A | 4/1951 | Fiandt |
| 2,554,943 | A | 5/1951 | Farmer |
| 2,556,017 | A | 6/1951 | Vonada |
| 2,560,534 | A | 7/1951 | Adler |
| 2,560,966 | A | 7/1951 | Lee |
| 2,569,577 | A | 10/1951 | Reading |
| 2,569,578 | A | 10/1951 | Rieger |
| 2,571,709 | A | 10/1951 | Gray |
| 2,576,074 | A | 11/1951 | Nachtman |
| 2,587,630 | A | 3/1952 | Konrad et al. |
| 2,619,454 | A | 11/1952 | Zapponi |
| 2,633,452 | A | 3/1953 | Hogaboom, Jr. et al. |
| 2,646,398 | A | 7/1953 | Henderson |
| 2,656,283 | A | 10/1953 | Fink et al. |
| 2,656,284 | A | 10/1953 | Toulmin |
| 2,657,177 | A | 10/1953 | Rendel |
| 2,657,457 | A | 11/1953 | Toulmin |
| 2,673,836 | A | 3/1954 | Vonada |
| 2,674,550 | A | 4/1954 | Dunlevy et al. |
| 2,675,348 | A | 4/1954 | Greenspan |
| 2,680,710 | A | 6/1954 | Kenmore et al. |
| 2,684,939 | A | 7/1954 | Geese |
| 2,689,215 | A | 9/1954 | Bart |
| 2,695,269 | A | 11/1954 | de Witz et al. |
| 2,696,859 | A | 12/1954 | Somma |
| 2,698,832 | A | 1/1955 | Swanson |
| 2,706,173 | A | 4/1955 | Wells et al. |
| 2,706,175 | A | 4/1955 | Licharz |
| 2,708,175 | A | 5/1955 | Manson et al. |
| 2,710,834 | A | 6/1955 | Vritakas |
| 2,711,993 | A | 6/1955 | Lyon |
| 3,162,588 | A | 12/1964 | Bell |
| 3,334,041 | A | 8/1967 | Dyer et al. |
| 3,433,730 | A | 3/1969 | Kennedy et al. |
| 3,448,023 | A | 6/1969 | Bell |
| 3,476,677 | A | 11/1969 | Corley et al. |
| 3,607,707 | A | 9/1971 | Chenevier |
| 3,873,512 | A | 3/1975 | Latanision |
| 3,942,959 | A | 3/1976 | Markoo et al. |
| 3,992,178 | A | 11/1976 | Markoo et al. |
| 4,047,902 | A | 9/1977 | Wiand |
| 4,082,638 | A | 4/1978 | Jumer |
| 4,119,515 | A | 10/1978 | Costakis |
| 4,125,444 | A | 11/1978 | Inoue |
| 4,312,716 | A | 1/1982 | Maschler et al. |
| 4,523,411 | A | 6/1985 | Freerks |
| 4,704,511 | A | 11/1987 | Miyano |
| 4,713,149 | A | 12/1987 | Hoshino |
| 4,752,371 | A | 6/1988 | Kreisel et al. |
| 4,772,361 | A | 9/1988 | Dorsett et al. |
| 4,793,895 | A | 12/1988 | Kaanta et al. |
| 4,839,993 | A | 6/1989 | Masuko et al. |
| 4,934,102 | A | 6/1990 | Leach et al. |
| 4,954,141 | A | 9/1990 | Takiyama et al. |
| 4,956,056 | A | 9/1990 | Zubatova et al. |
| 5,011,510 | A | 4/1991 | Hayakawa et al. |
| 5,061,294 | A | 10/1991 | Harmer et al. |
| 5,066,370 | A | 11/1991 | Andreshak et al. |
| 5,096,550 | A | 3/1992 | Mayer et al. |
| 5,108,463 | A | 4/1992 | Buchanan |
| 5,136,817 | A | 8/1992 | Tabata et al. |
| 5,137,542 | A | 8/1992 | Buchanan et al. |
| 5,203,884 | A | 4/1993 | Buchanan et al. |
| 5,217,586 | A | 6/1993 | Datta et al. |
| 5,225,034 | A | 7/1993 | Yu et al. |
| 5,257,478 | A | 11/1993 | Hyde et al. |
| 5,328,716 | A | 7/1994 | Buchanan |
| 5,478,435 | A | 12/1995 | Murphy et al. |
| 5,534,106 | A | 7/1996 | Cote et al. |
| 5,543,032 | A | 8/1996 | Datta et al. |
| 5,560,753 | A | 10/1996 | Schnabel et al. |
| 5,562,529 | A | 10/1996 | Kishii et al. |
| 5,567,300 | A | 10/1996 | Datta et al. |
| 5,575,706 | A | 11/1996 | Tsai et al. |
| 5,578,362 | A | 11/1996 | Reinhardt et al. |
| 5,624,300 | A | 4/1997 | Kishii et al. |
| 5,633,068 | A | 5/1997 | Ryoke et al. |
| 5,654,078 | A | 8/1997 | Ferronato |
| 5,702,811 | A | 12/1997 | Ho et al. |
| 5,738,574 | A | 4/1998 | Tolles et al. |
| 5,804,507 | A | 9/1998 | Perlov et al. |
| 5,807,165 | A | 9/1998 | Uzoh et al. |
| 5,823,854 | A | 10/1998 | Chen |
| 5,840,190 | A | 11/1998 | Scholander et al. |
| 5,840,629 | A | 11/1998 | Carpio |
| 5,846,882 | A | 12/1998 | Birang |
| 5,871,392 | A | 2/1999 | Meikle et al. |
| 5,882,491 | A | 3/1999 | Wardle |
| 5,893,796 | A | 4/1999 | Birang et al. |
| 5,911,619 | A | 6/1999 | Uzoh et al. |
| 5,938,801 | A | 8/1999 | Robinson |
| 5,948,697 | A | 9/1999 | Hata |
| 5,985,093 | A | 11/1999 | Chen |
| 6,001,008 | A | 12/1999 | Fujimori et al. |
| 6,004,880 | A | 12/1999 | Liu et al. |
| 6,017,265 | A | 1/2000 | Cook et al. |
| 6,020,264 | A | 2/2000 | Lustig et al. |
| 6,024,630 | A | 2/2000 | Shendon et al. |
| 6,033,293 | A | 3/2000 | Crevasse et al. |
| 6,056,851 | A | 5/2000 | Hsieh et al. |
| 6,066,030 | A | 5/2000 | Uzoh |
| 6,074,284 | A | 6/2000 | Tani et al. |
| 6,077,337 | A | 6/2000 | Lee |
| 6,090,239 | A | 7/2000 | Liu et al. |
| 6,103,096 | A | 8/2000 | Datta et al. |
| 6,116,998 | A | 9/2000 | Damgaard et al. |
| 6,132,292 | A | 10/2000 | Kubo |
| 6,153,043 | A | 11/2000 | Edelstein et al. |
| 6,156,124 | A | 12/2000 | Tobin |
| 6,159,079 | A | 12/2000 | Zuniga et al. |
| 6,171,467 | B1 | 1/2001 | Weihs et al. |
| 6,176,992 | B1 | 1/2001 | Talieh |
| 6,176,998 | B1 | 1/2001 | Wardle et al. |
| 6,183,354 | B1 | 2/2001 | Zuniga et al. |
| 6,190,494 | B1 | 2/2001 | Dow |
| 6,210,257 | B1 | 4/2001 | Carlson |
| 6,234,870 | B1 | 5/2001 | Uzoh et al. |
| 6,238,271 | B1 | 5/2001 | Cesna |
| 6,238,592 | B1 | 5/2001 | Hardy et al. |
| 6,248,222 | B1 | 6/2001 | Wang |
| 6,251,235 | B1 | 6/2001 | Talieh et al. |
| 6,257,953 | B1 | 7/2001 | Gitis et al. |
| 6,258,223 | B1 | 7/2001 | Cheung et al. |
| 6,261,168 | B1 | 7/2001 | Jensen et al. |
| 6,261,959 | B1 | 7/2001 | Travis et al. |
| 6,273,798 | B1 | 8/2001 | Berman |
| 6,296,557 | B1 | 10/2001 | Walker |
| 6,297,159 | B1 | 10/2001 | Paton |
| 6,319,108 | B1 | 11/2001 | Adefris et al. |
| 6,319,420 | B1 | 11/2001 | Dow |
| 6,322,422 | B1 | 11/2001 | Satou |

| | | | |
|---|---|---|---|
| 6,328,642 | B1 | 12/2001 | Pant et al. |
| 6,328,872 | B1 | 12/2001 | Talieh et al. |
| 6,331,135 | B1 | 12/2001 | Sabde et al. |
| 6,368,184 | B1 | 4/2002 | Beckage |
| 6,368,190 | B1 | 4/2002 | Easter et al. |
| 6,381,169 | B1 | 4/2002 | Bocian et al. |
| 6,383,066 | B1 | 5/2002 | Chen et al. |
| 6,386,956 | B1 | 5/2002 | Sato et al. |
| 6,391,166 | B1 | 5/2002 | Wang |
| 6,395,152 | B1 | 5/2002 | Wang |
| 6,402,591 | B1 | 6/2002 | Thornton |
| 6,406,363 | B1 | 6/2002 | Xu et al. |
| 6,409,904 | B1 | 6/2002 | Uzoh et al. |
| 6,428,394 | B1 | 8/2002 | Mooring et al. |
| 6,431,968 | B1 | 8/2002 | Chen et al. |
| 6,440,295 | B1 | 8/2002 | Wang |
| 6,447,668 | B1 | 9/2002 | Wang |
| 6,471,847 | B2 | 10/2002 | Talieh et al. |
| 6,475,332 | B1 | 11/2002 | Boyd et al. |
| 6,497,800 | B1 | 12/2002 | Talieh et al. |
| 6,517,426 | B2 | 2/2003 | Lee |
| 6,520,843 | B1 | 2/2003 | Halley |
| 6,537,140 | B1 | 3/2003 | Miller et al. |
| 6,537,144 | B1 | 3/2003 | Tsai et al. |
| 6,551,179 | B1 | 4/2003 | Halley |
| 6,561,873 | B2 | 5/2003 | Tsai et al. |
| 6,561,889 | B1 | 5/2003 | Xu et al. |
| 6,569,004 | B1 | 5/2003 | Pham |
| 6,572,463 | B1 | 6/2003 | Xu et al. |
| 6,585,579 | B2 | 7/2003 | Jensen et al. |
| 6,630,059 | B1 | 10/2003 | Uzoh et al. |
| 6,641,471 | B1 | 11/2003 | Pinheiro et al. |
| 6,656,019 | B1 | 12/2003 | Chen et al. |
| 6,685,548 | B2 | 2/2004 | Chen et al. |
| 6,692,338 | B1 | 2/2004 | Kirchner |
| 6,739,951 | B2 | 5/2004 | Sun et al. |
| 6,752,700 | B2 | 6/2004 | Duescher |
| 6,769,969 | B1 | 8/2004 | Duescher |
| 6,802,955 | B2 | 10/2004 | Emesh et al. |
| 6,848,977 | B1 | 2/2005 | Cook et al. |
| 6,856,761 | B2 | 2/2005 | Doran |
| 6,962,524 | B2 | 11/2005 | Butterfield et al. |
| 2001/0005667 | A1 | 6/2001 | Tolles et al. |
| 2001/0024878 | A1 | 9/2001 | Nakamura |
| 2001/0027018 | A1 | 10/2001 | Molnar |
| 2001/0035354 | A1 | 11/2001 | Ashjaee et al. |
| 2001/0036746 | A1 | 11/2001 | Sato et al. |
| 2001/0040100 | A1 | 11/2001 | Wang |
| 2001/0042690 | A1 | 11/2001 | Talieh |
| 2002/0008036 | A1 | 1/2002 | Wang |
| 2002/0011417 | A1 | 1/2002 | Talieh et al. |
| 2002/0020621 | A1 | 2/2002 | Uzoh et al. |
| 2002/0025760 | A1 | 2/2002 | Lee et al. |
| 2002/0025763 | A1 | 2/2002 | Lee et al. |
| 2002/0070126 | A1 | 6/2002 | Sato et al. |
| 2002/0077037 | A1 | 6/2002 | Tietz |
| 2002/0088715 | A1 | 7/2002 | Talieh et al. |
| 2002/0102853 | A1 | 8/2002 | Li et al. |
| 2002/0108861 | A1 | 8/2002 | Emesh et al. |
| 2002/0119286 | A1 | 8/2002 | Chen et al. |
| 2002/0123300 | A1 | 9/2002 | Jones et al. |
| 2002/0130049 | A1 | 9/2002 | Chen et al. |
| 2002/0130634 | A1 | 9/2002 | Ziemkowski et al. |
| 2002/0146963 | A1 | 10/2002 | Teetzel |
| 2002/0148732 | A1 | 10/2002 | Emesh et al. |
| 2003/0034131 | A1 | 2/2003 | Park et al. |
| 2003/0040188 | A1 | 2/2003 | Hsu et al. |
| 2003/0114087 | A1 | 6/2003 | Duboust et al. |
| 2003/0116445 | A1 | 6/2003 | Sun et al. |
| 2003/0116446 | A1 | 6/2003 | Duboust et al. |
| 2003/0209448 | A1 | 11/2003 | Hu et al. |
| 2003/0213703 | A1 | 11/2003 | Wang et al. |
| 2003/0220053 | A1 | 11/2003 | Manens et al. |
| 2004/0020788 | A1 | 2/2004 | Mavliev et al. |
| 2004/0020789 | A1 | 2/2004 | Hu |
| 2004/0023495 | A1 | 2/2004 | Butterfield et al. |
| 2004/0082288 | A1 | 4/2004 | Tietz et al. |
| 2004/0121708 | A1 | 6/2004 | Hu et al. |
| 2004/0134792 | A1 | 7/2004 | Butterfield et al. |
| 2004/0163946 | A1 | 8/2004 | Chang et al. |
| 2004/0266327 | A1 | 12/2004 | Chen et al. |
| 2005/0000801 | A1 | 1/2005 | Wang et al. |
| 2005/0092621 | A1 | 5/2005 | Hu et al. |
| 2005/0133363 | A1 | 6/2005 | Hu et al. |
| 2005/0161341 | A1 | 7/2005 | Duboust et al. |
| 2005/0178666 | A1 | 8/2005 | Tsai et al. |
| 2005/0194681 | A1* | 9/2005 | Hu et al. ..... 257/737 |
| 2006/0070872 | A1* | 4/2006 | Mavliev et al. ..... 204/224 M |
| 2006/0073768 | A1* | 4/2006 | Mavliev et al. ..... 451/6 |
| 2007/0215488 | A1* | 9/2007 | Wang et al. ..... 205/662 |

FOREIGN PATENT DOCUMENTS

| | | |
|---|---|---|
| EP | 0 455 455 | 11/1991 |
| EP | 1 361 023 | 11/2003 |
| JP | 58-171264 | 10/1983 |
| JP | 61-079666 | 4/1986 |
| JP | 61-265279 | 11/1986 |
| JP | 63-028512 | 2/1988 |
| JP | 05-277957 | 10/1993 |
| JP | 06-047678 | 2/1994 |
| JP | 10-006213 | 1/1998 |
| JP | 11-042554 | 2/1999 |
| JP | 11-239961 | 7/1999 |
| JP | 2870537 | 11/1999 |
| JP | 2000-218513 | 8/2000 |
| JP | 11-216663 | 12/2000 |
| JP | 2001-77117 | 3/2001 |
| JP | 2001-179611 | 7/2001 |
| JP | 2001-244223 | 9/2001 |
| JP | 3453352 | 10/2003 |
| KR | 2003-037158 | 5/2003 |
| SU | 1618538 | 1/1991 |
| WO | WO 93/15879 | 8/1993 |
| WO | WO 98/49723 | 11/1998 |
| WO | WO 99/41434 | 8/1999 |
| WO | WO 99/53119 | 10/1999 |
| WO | WO 99/65072 | 12/1999 |
| WO | WO 00/03426 | 1/2000 |
| WO | WO 00/26443 | 5/2000 |
| WO | WO 00/33356 | 6/2000 |
| WO | WO 00/59682 | 10/2000 |
| WO | WO 00/71297 | 11/2000 |
| WO | WO 01/13416 | 2/2001 |
| WO | WO 01/49452 | 7/2001 |
| WO | WO 01/52307 | 7/2001 |
| WO | WO 01/63018 | 8/2001 |
| WO | WO 01/71066 | 9/2001 |
| WO | WO 01/88229 | 11/2001 |
| WO | WO 01/88954 | 11/2001 |
| WO | WO 02/23616 | 3/2002 |
| WO | WO 02/064314 | 8/2002 |
| WO | WO 02/075804 | 9/2002 |
| WO | WO 03/001581 | 1/2003 |

OTHER PUBLICATIONS

Partial International Search / PCT Invitation to pay additional fees dated Nov. 14, 2002.

Notification regarding review of justification for invitation to pay additional fees for PCT/US/02/11009 dated Feb. 25, 2003.

International Search Report for PCT/US 02/11009 dated Feb. 25, 2003.

PCT Written Opinion dated Apr. 1, 2003 for PCT/US02/11009.

Notification of Transmittal of International Preliminary Examination Report dated Nov. 10, 2003.

European Search Report for 03252801.0, dated Jan. 16, 2004.

Communication pursuant to Article 96(2) EPC for Application No. 02728965.4, dated Jun. 11, 2004.

Search Report issued by the Austrian Patent Office for corresponding Singapore Patent Application No. 200302562-4, provided by letter dated Oct. 7, 2004.

Invitation to pay additional fees dated Nov. 11, 2004.

Notification of Transmittal of International Preliminary Examination Report and Written Opinion dated Feb. 21, 2005.

Notification of transmittal of the International Search report and Written Opinion dated Mar. 14, 2005.

PCT International Search Report and Written Opinion dated Apr. 28, 2005 for PCT/US04/037870.

Alexander, Jr., "Electrically Conductive Polymer Nanocomposite Materials", http://www.afrlhorizons.com/Briefs/Sept02/ML0206.html.

Contolini, "Electrochemical Planarization of ULSI Copper," Solid State Technology, vol. 40, No. 6, Jun. 1, 1997.

Nogami, "An Innovation to Integrate Porous Low-K Materials and Copper," InterConnect Japan 2001; Honeywell Seminar Dec. 6, 2001, p. 1-12.

* cited by examiner

CONDUCTIVE PAD

Embodiments of the present invention generally relate to planarizing or polishing a substrate. More particularly, the invention relates to polishing pad designs and methods for manufacturing a polishing pad adapted to remove materials from a substrate by electrochemical mechanical planarization.

DESCRIPTION OF THE RELATED ART

In the fabrication of integrated circuits and other electronic devices on substrates, multiple layers of conductive, semiconductive, and dielectric materials are deposited on or removed from a feature side, i.e., a deposit receiving surface, of a substrate. As layers of materials are sequentially deposited and removed, the feature side of the substrate may become non-planar and require planarization. Planarization is a procedure where previously deposited material is removed from the feature side of a substrate to form a generally even, planar or level surface. The process is useful in removing undesired surface topography and surface defects, such as rough surfaces, agglomerated materials, crystal lattice damage and scratches. The planarization process is also useful in forming features on a substrate by removing excess deposited material used to fill the features and to provide an even or level surface for subsequent deposition and processing.

Electrochemical Mechanical Planarization (ECMP) is one exemplary process which is used to remove materials from the feature side of a substrate. ECMP typically uses a pad having conductive properties adapted to combine physical abrasion with electrochemical activity that enhances the removal of materials. In one exemplary process, the pad is attached to an apparatus having a rotating platen assembly that is adapted to couple the pad to a power source. The apparatus also has a substrate carrier, such as a polishing head, that is mounted on a carrier assembly above the pad that holds a substrate. The polishing head places the substrate in contact with the pad and is adapted to provide downward pressure, controllably urging the substrate against the pad. The pad is moved relative to the substrate by an external driving force and the polishing head typically moves relative to the moving pad. A chemical composition, such as an electrolyte, is typically provided to the surface of the pad which enhances electrochemical activity between the pad and the substrate. The ECMP apparatus effects abrasive or polishing activity from frictional movement while the electrolyte combined with the conductive properties of the pad selectively removes material from the feature side of the substrate.

Although ECMP has produced good results in recent years, there is an ongoing effort to develop pads with improved polishing qualities combined with optimal electrical properties that will not degrade over time and requires less conditioning, thus providing extended periods of use with less downtime for replacement. Inherent in this challenge is the difficulty in producing a pad that will not react with process chemistry, which may cause degradation or require excessive conditioning.

Therefore, there is a need for a conductive polishing pad that will not react with process chemistry and utilizes materials and design that requires less frequent conditioning.

SUMMARY OF THE INVENTION

The present invention generally provides a polishing pad for polishing or planarizing a layer on a substrate using electrochemical dissolution processes, polishing processes, or combinations thereof, and methods of manufacturing the same.

In one embodiment, a pad assembly for processing a substrate is disclosed. The pad assembly comprises a conductive processing pad made of a conductive composite material disposed on a conductive carrier. The conductive composite material may be embossed or compressed to form a plurality of raised features that extend from an upper surface of the conductive carrier defining a plurality of channels. The plurality of raised portions may comprise ovals or polygons, such as squares or rectangles, which extend upwardly from the conductive carrier. The pad assembly further comprises a sub-pad that is adhered to an opposing conductive layer, such as an electrode. The conductive carrier and the electrode may each have an appropriate attachment that allows connection to a power source.

In another embodiment, a pad assembly for processing a substrate comprises a conductive processing pad having a conductive carrier with a conductive composite on an upper and a lower surface. The conductive composite material may be embossed or compressed to form a plurality of raised portions that define a plurality of channels therebetween on the upper surface. A plurality of lower features are also formed on the lower surface of the conductive carrier. The raised features extending from the upper surface of the conductive carrier may comprise ovals or polygons, such as squares or rectangles that extend upwardly from the upper surface of the conductive carrier. In another embodiment, the lower features on the lower surface of the conductive carrier, extend orthogonally from the conductive carrier into the sub-pad, may take the shapes defined above and may further be chambered or conical. The pad assembly further comprises a sub-pad adhered to the conductive carrier and the plurality of lower features extending therein, and an opposing conductive layer, such as an electrode, adhered to the sub-pad. The conductive carrier and the opposing conductive layer may each have an electrical attachment that allows connection to opposing poles of a power source.

In another embodiment, a method of manufacturing a processing pad assembly is disclosed. The method comprises the steps of depositing a conductive composite material on a conductive carrier, compressing a first and second perforated metal plate onto the conductive composite material before it is cured, shifting the second perforated plate relative the first plate after the material has cured, removing the first perforated plate from the conductive composite, and adhering the conductive carrier to a sub pad disposed on an electrode.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The words and phrases used in the present invention should be given their ordinary and customary meaning in the art by one skilled in the art unless otherwise further defined. The embodiments described herein may relate to removing material from a substrate, but may be equally effective for electroplating a substrate by adjusting the polarity of an electrical source.

Figure 1:
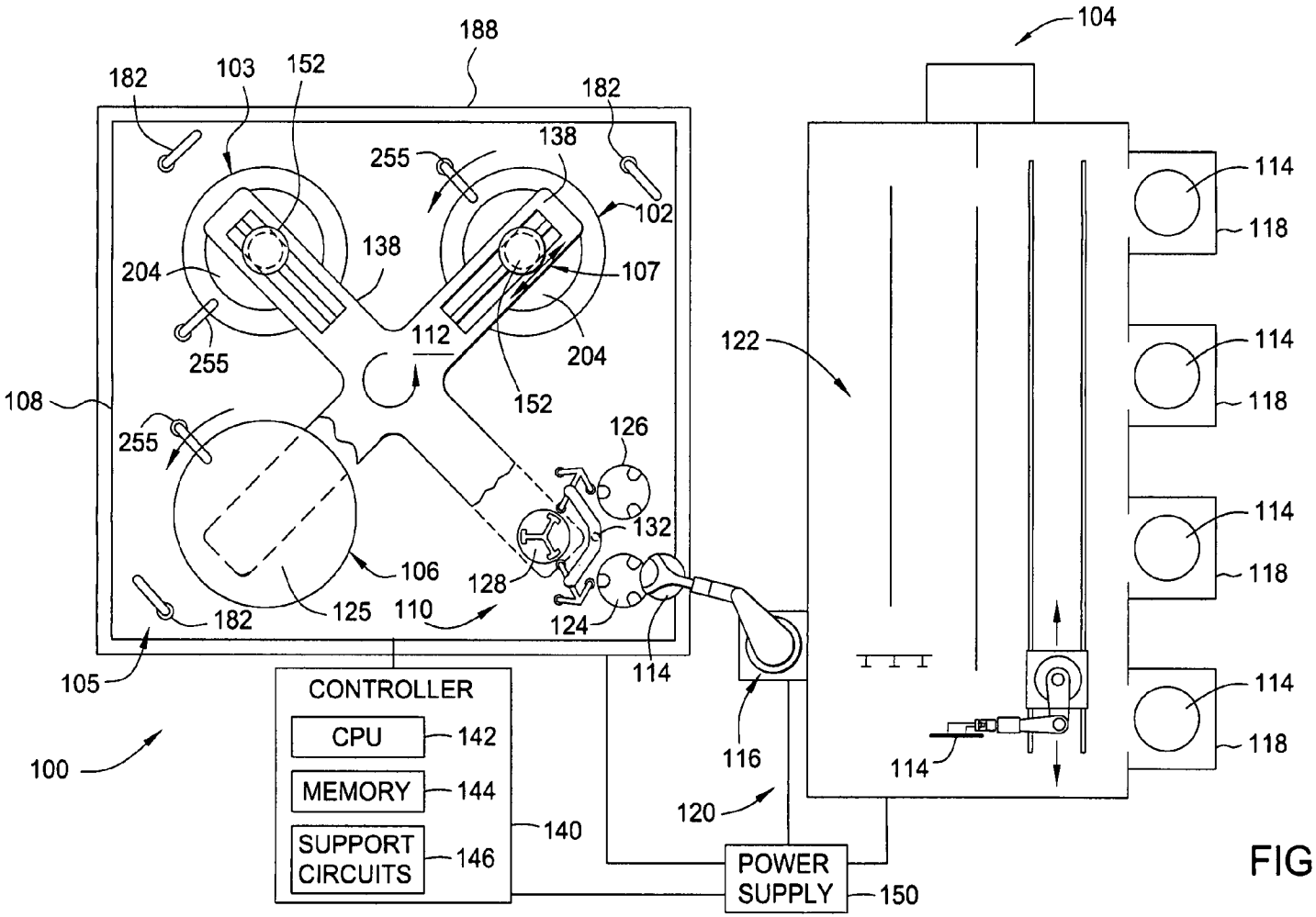
FIG. 1 is a plan view of one embodiment of a processing system suitable for polishing a substrate.

FIG. 1 is a plan view a processing system 100 having a planarizing module 105 that is suitable for electrochemical mechanical polishing and chemical mechanical polishing. The planarizing module 105 includes at least a first electrochemical mechanical planarization (ECMP) station 102, and optionally, at least one conventional chemical mechanical planarization (CMP) station 106 disposed in an environmentally controlled enclosure 188. An example of a processing system 100 that may be adapted to practice the invention is the REFLEXION LK ECMP™ system available from Applied Materials, Inc. located in Santa Clara, Calif. Other planarizing modules commonly used in the art may also be adapted to practice the invention.

The planarizing module 105 shown in FIG. 1 includes a first ECMP station 102, a second ECMP station 103, and one CMP station 106. It is to be understood that the invention is not limited to this configuration and that all of the stations 102, 103, and 106 may be adapted to use an ECMP process to remove various layers deposited on the substrate. Alternatively, the planarizing module 105 may include two stations that are adapted to perform a CMP process while another station may perform an ECMP process. In one exemplary process, a substrate having feature definitions formed therein and filled with a barrier layer and then a conductive material disposed over the barrier layer may have the conductive material removed in two steps in the two ECMP stations 102,103, with the barrier layer processed in the conventional CMP station 106 to form a planarized surface on the substrate. It is to be noted that the stations 102, 103, and 106 in any of the combinations mentioned above may also be adapted to deposit a material on a substrate by an electrochemical and/or an electrochemical mechanical plating process.

The exemplary system 100 generally includes a base 108 that supports one or more ECMP stations 102,103, one or more polishing stations 106, a transfer station 110, conditioning devices 182, and a carousel 112. The transfer station 110 generally facilitates transfer of substrates 114 to and from the system 100 via a loading robot 116. The loading robot 116 typically transfers substrates 114 between the transfer station 110 and an interface 120 that may include a cleaning module 122, a metrology device 104 and one or more substrate storage cassettes 1 18.

The transfer station 110 comprises at least an input buffer station 124, an output buffer station 126, a transfer robot 132, and a load cup assembly 128. The loading robot 116 places the substrate 114 onto the input buffer station 124. The transfer robot 132 has two gripper assemblies, each having pneumatic gripper fingers that hold the substrate 114 by the substrate's edge. The transfer robot 132 lifts the substrate 114 from the input buffer station 124 and rotates the gripper and substrate 114 to position the substrate 114 over the load cup assembly 128, then places the substrate 114 down onto the load cup assembly 128. An example of a transfer station that may be used is described in U.S. Pat. No. 6,156,124, issued Dec. 5, 2000, entitled "Wafer Transfer Station for a Chemical Mechanical Polisher," incorporated herein by reference.

The carousel 112 generally supports a plurality of carrier heads 204, each of which retains one substrate 114 during processing. The carousel 112 articulates the carrier heads 204 between the transfer station 110 and stations 102,103 and 106. One carousel that may used is generally described in U.S. Pat. No. 5,804,507, issued Sep. 8, 1998, entitled "Radially Oscillating Carousel Processing System for Chemical Mechanical Polishing," which is hereby incorporated by reference.

The carousel 112 is centrally disposed on the base 108. The carousel 112 typically includes a plurality of arms 138. Each arm 138 generally supports one of the carrier heads 204. Two of the arms 138 depicted in FIG. 1 are shown in phantom so that the transfer station 110 and a conductive processing pad 125 of ECMP station 102 may be seen. The carousel 112 is indexable such that the carrier head 204 may be moved between stations 102, 103, 106 and the transfer station 110 in a sequence defined by the user.

Generally the carrier head 204 retains the substrate 114 while the substrate 114 is disposed in the ECMP stations 102, 103 or polishing station 106. The arrangement of the ECMP stations 102, 103 and polishing stations 106 on the system 100 allow for the substrate 114 to be sequentially processed by moving the substrate between stations while being retained in the same carrier head 204.

To facilitate control of the polishing system 100 and processes performed thereon, a controller 140 comprising a central processing unit (CPU) 142, memory 144 and support circuits 146 is connected to the polishing system 100. The CPU 142 may be one of any form of computer processor that can be used in an industrial setting for controlling various drives and pressures. The memory 144 is connected to the CPU 142. The memory 144, or computer-readable medium, may be one or more of readily available memory such as random access memory (RAM), read only memory (ROM), floppy disk, hard disk, or any other form of digital storage, local or remote. The support circuits 146 are connected to the CPU 142 for supporting the processor in a conventional manner. These circuits include cache, power supplies, clock circuits, input/output circuitry, subsystems, and the like.

Power to operate the polishing system 100 and/or the controller 140 is provided by a power supply 150. Illustratively, the power supply 150 is shown connected to multiple components of the polishing system 100, including the transfer station 110, the interface 120, the loading robot 116 and the controller 140.

Figure 2:
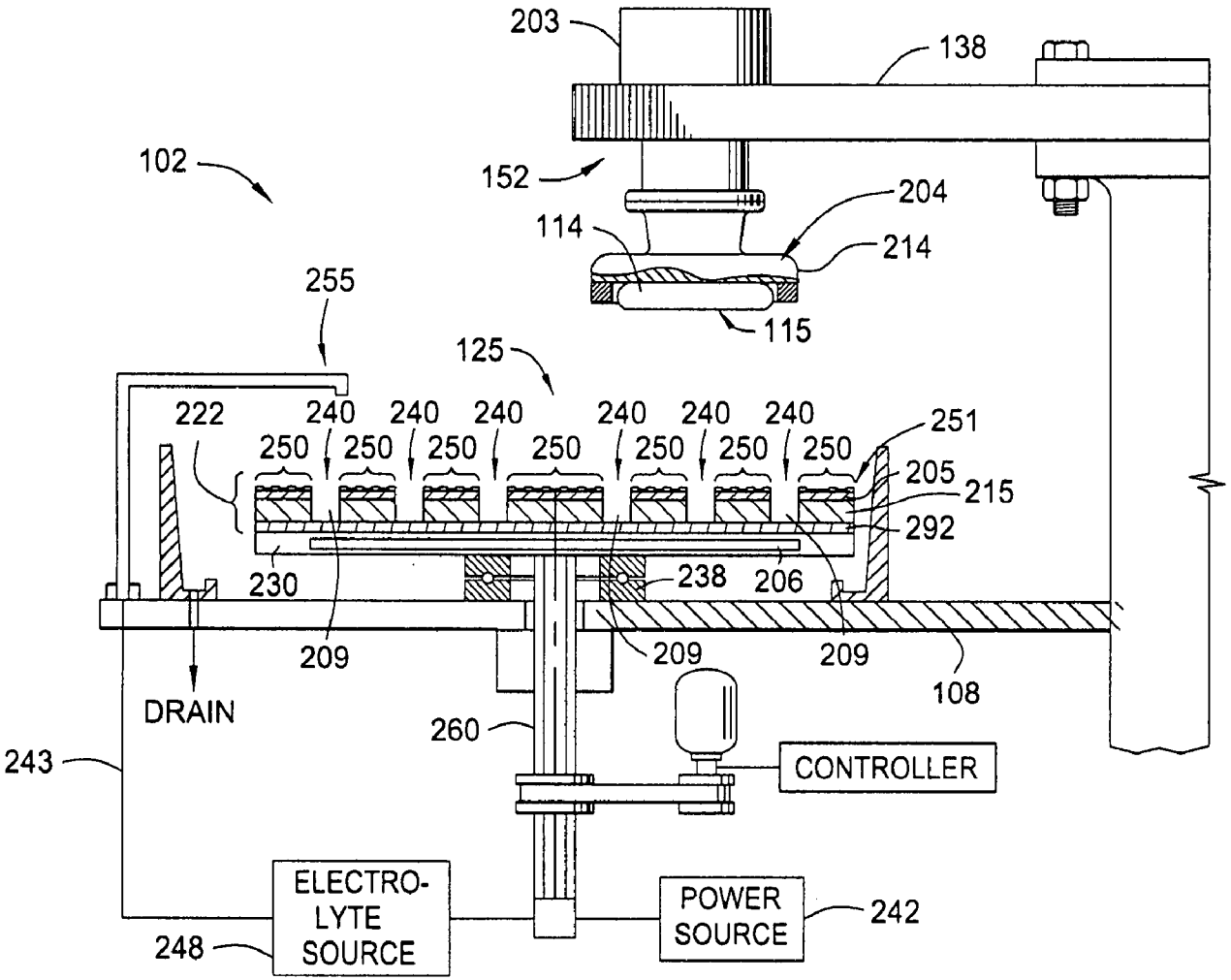
FIG. 2 is a sectional view of one embodiment of an exemplary ECMP station.

FIG. 2 depicts a sectional view of an exemplary ECMP station depicting a carrier head assembly 152 positioned over the ECMP station 102. The carrier head assembly 152 generally comprises a drive system 203 coupled to a carrier head 204. The drive system 203 generally provides at least rotational motion to the carrier head 204 and additionally may be actuated toward the ECMP station 102 such that the substrate 114, retained in the carrier head 204, may be disposed against the pad assembly 222 of the ECMP station 102 during processing. The head assembly 152 may also move in a path indicated by arrow 107 in FIG. 1 during processing. The drive system 203 may be coupled to the controller 140 (FIG. 1) that provides a signal to the drive system 203 for controlling the rotational speed and direction of the carrier head 204.

The ECMP station 102 also generally includes a platen assembly 230 that is rotationally disposed on the base 108. The platen assembly 230 is supported above the base 108 by a bearing 238 so that the platen assembly 230 may be rotated relative to the base 108. The platen assembly 230 may be fabricated from a rigid material, such as a metal or rigid plastic, and in one embodiment the platen assembly 230 has an upper surface that is fabricated from or coated with a dielectric material, such as CPVC. The platen assembly 230 may have a circular, rectangular or other plane form.

Electrolyte may be provided from the source 248, through appropriate plumbing and controls, such as conduit 243, to nozzle 255 above the processing pad assembly 222 of the ECMP station 102. Optionally, a plenum 206 may be defined in the platen assembly 230 for containing an electrolyte and facilitating ingress and egress of the electrolyte to the pad assembly 222. A detailed description of an exemplary planarizing assembly suitable for incorporation with the present invention can be found in the description of the Figures in United States Patent Publication No. 2004/0163946, entitled "Pad Assembly for Electrochemical Mechanical Processing," filed Dec. 23, 2003 and incorporated herein by reference.

The pad assembly 222 shown in FIG. 2, which will be described in detail in reference to FIGS. 3-11, generally includes a conductive processing pad 125, a sub-pad 215, and an opposing conductive medium, such as an electrode 292, coupled to an upper surface of the platen assembly 230. The conductive processing pad 125 includes a conductive carrier 205 with a conductive composite material 251 disposed thereon and is coupled to one pole of the power source 242. The electrode 292 is coupled to an opposing pole of the power source 242. The conductive carrier 205 and the electrode 292 are coupled through appropriate connections to the power source 242 routed through a shaft 260 coupled to the platen assembly 230.

A plurality of permeable passages 209 extend through the pad assembly 222 at least to the electrode 292. The plurality of permeable passages 209 collectively form an open area 240 of the pad assembly 222 while the remaining features of the pad assembly 222 form a supported area 250. Each permeable passage is of a size and location within the pad assembly 222 to allow an electrolyte flowed onto the pad assembly to form a plurality of electrochemical cells within the pad assembly 222, thus facilitating anodic dissolution of a conductive material on a substrate or alternatively depositing material on a substrate via electroplating. The open area 240 relative the supported area 250 will form an open area percentage that is configured to enhance the polishing or deposition process. The open area percentage employed will optimize a polishing process by providing a plurality of electrochemical cells in the pad assembly 222, thereby optimizing anodic dissolution, and optimize abrasion provided by the supported area 250. The percentage of the open area 240 may be varied based on desired process parameters such as electrolyte chemistry, abrasive and physical properties of the supported area 250, and electrical properties of the pad assembly 222. It is to be understood that the open area 240 may be formed by one permeable passage 209 instead of collectively by a plurality of permeable passages. The processing pad assembly 222 contemplated by the invention has an open area that is in a range of about 10% to about 90% of the area of the pad assembly, for example about 25% to about 75%.

Figure 3:
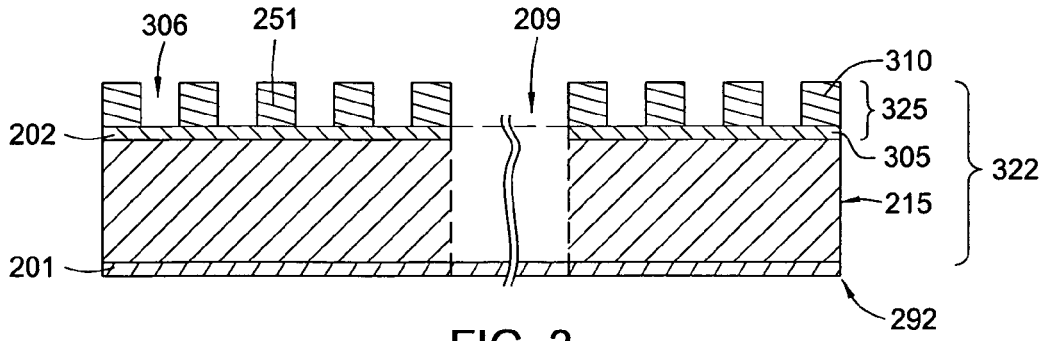
FIG. 3 is a partial schematic cross-sectional view of a process pad assembly depicting one embodiment of a pad body.

FIG. 3 is a partial schematic cross-sectional view of one embodiment of a pad assembly 322. The pad assembly 322 includes a conductive processing pad 325, a sub pad 215, and an opposing conductive layer, such as an electrode 292. The conductive processing pad 325 includes a conductive carrier 305 with a conductive composite material 251 thereon. The conductive composite material 251 is embossed, molded, or otherwise formed to define a suitable pattern thereon. Features having a rectangular pattern, a triangular pattern, an annular pattern, or any other uniformly distributed pattern on the upper surface of the pad assembly 322 may be formed. In this embodiment, the conductive composite material 251 comprises a plurality of raised features 310 extending upwardly from the conductive carrier 305. The raised features 310 form a plurality of channels 306 therebetween on the upper side of the conductive carrier 305. The raised features 310 may take the shape of ovals or polygons, such as squares or rectangles and define the channels 306, which aid in electrolyte retention on the processing pad 325. The pad assembly 322 also includes at least one permeable passage 209 sized and located to provide a suitable open area percentage for enhanced electrolyte retention and electrochemical cell function.

The pad assembly 322 has an electrical connection, such as a terminal 202 that is in electrical communication with the conductive processing pad 325 through the conductive carrier 305 and is adapted to electrically bias the substrate 114 (FIG. 2) during processing by communicating the bias to the feature side 115, thereby electrically coupling the substrate 114 to one terminal of the power source 242. The electrode 292 of the pad assembly 322 is coupled to another junction 201 that is connected to an opposite pole of the power source 242. The electrolyte, which is introduced from the electrolyte source 248 and is delivered to the pad assembly 222, promotes electrochemical activity between the substrate 114 and the electrode 292 of the pad assembly 322. This electrochemical activity assists in the removal of material from the feature side 1 15 of the substrate 114.

The conductive composite material 251 disposed on the conductive carrier 305 may comprise a conductive polishing material including conductive fibers, conductive fillers, or combinations thereof. The conductive fibers, conductive fillers, or combinations thereof may be dispersed in a binder to form a conductive composite material 251. One form of binder material is a conventional polishing material. Conventional polishing materials are generally dielectric materials such as dielectric polymeric materials. Examples of dielectric polymeric polishing materials include polyurethane and polyurethane mixed with fillers, polycarbonate, polyphenylene sulfide (PPS), Teflon® polymers, polystyrene, ethylene-propylene-diene-methylene (EPDM), or combinations thereof, and other polishing materials used in polishing substrate surfaces. The conventional polishing material may also include felt fibers impregnated in urethane or be in a foamed state. It is contemplated herein that any conventional polishing material may be used as a binder material, also known as a matrix, with the conductive fibers and fillers described herein.

Additives may be added to the binder material to assist in the dispersion of conductive fibers, conductive fillers or combinations thereof, in the polymer materials. Additives may be used to improve the mechanical, thermal, and electrical properties of the polishing material formed from the fibers and/or fillers and the binder material. Additives may include cross-linkers for improving polymer cross-linking and dispersants for dispersing conductive fibers or conductive fillers more uniformly in the binder material. Examples of cross-linkers include amino compounds, silane crosslinkers, polyisocyanate compounds, and combinations thereof. Examples of dispersants include N-substituted long-chain alkenyl succinimides, amine salts of high-molecular-weight organic acids, co-polymers of methacrylic or acrylic acid derivatives containing polar groups such as amines, amides, imines, imides, hydroxyl, and ether, and ethylene-propylene copolymers containing polar groups such as amines, amides, imines, imides, hydroxyls, and ethers. In addition, sulfur containing compounds, such as thioglycolic acid and related esters have been observed as effective dispersers for gold coated fibers and fillers in binder materials. The invention contemplates that the amount and types of additives will vary for the fibers or filler material as well as the binder material used, and the above examples are illustrative and should not be construed or interpreted as limiting the scope of the invention.

In another embodiment, the conductive composite material 251 consists of tin particles disposed in a polymer matrix, the conductive composite material 251 being adhesively bound to or formed on the conductive carrier 305 to allow electrical communication between the conductive carrier 305 and the conductive composite material 251. In another embodiment, the conductive composite material 251 consists of nickel and/or copper particles disposed in a polymer matrix, the conductive composite material 251 being adhesively bound to or formed on the conductive carrier 305 to allow electrical communication between the conductive carrier 305 and the conductive composite material. The mixture of particles in the polymer matrix may be disposed over a dielectric fabric coated with metal, such as copper, tin, or gold, and the like.

The conductive carrier 305 may be a plate-like member or laminate, a plate having multiple apertures formed therethrough, or a plurality of conductive elements disposed in a permeable membrane. Materials used for the conductive carrier may comprise a conductive material, such as stainless steel, copper, aluminum, gold, silver and tungsten, among others. The conductive carrier may be further be coated with the above materials. For example, conductive carrier 305 may be a metal foil, a mesh made of metal wire or metal-coated wire, or a laminated metal layer on a polymer film compatible with the electrolyte, such as a polyimide, polyester, flouroethylene, polypropylene, or polyethylene sheet.

It is contemplated that a conductive carrier 305 made of tin will permit a larger surface area to be exposed to the electrolyte while avoiding adverse reaction with the process chemistry. For example, tin is substantially inert relative to the process chemistries used to remove conductive material, such as copper and tungsten from a substrate. By incorporating tin particles in the conductive composite material 251 and using a conductive carrier 305 made of tin, it is contemplated that the process will be enhanced by longer life of the pad assembly 322 since the conductive carrier 305 may resist degradation during processing.

The electrode 292 can be a plate-like member or laminate, a plate having multiple apertures formed therethrough, or a plurality of electrode pieces disposed in a permeable membrane or container. For example, the electrode 292 may be a metal foil, a mesh made of metal wire or metal-coated wire, or a laminated metal layer on a polymer film compatible with the electrolyte, such as a polyimide, polyester, flouroethylene, polypropylene, or polyethylene sheet. The electrode 292 may act as a single electrode, or may comprise multiple independent electrode zones isolated from each other. Zoned electrodes which may be used are disclosed in United States Patent Publication No. 2004/0082289, entitled "Conductive Polishing Article for Electrochemical Mechanical Polishing," filed Aug. 15, 2003, previously incorporated herein by reference.

The sub-pad 215 is typically made of a softer material, or more compliant material than conductive processing pad 325. The difference in hardness, durometer, or modulus of elasticity between the processing pad 325 and the sub-pad 215 may be chosen to produce a desired polishing/plating performance. Examples of suitable sub-pad 215 materials include, but are not limited to, open or closed-cell foamed polymer, elastomers, felt, impregnated felt, plastics, and like materials compatible with the processing chemistries.

The electrode 292, sub-pad 215, and conductive processing pad 325 of the pad assembly 322 may be combined into a unitary assembly by the use of binders, adhesives, bonding, compression molding, or the like. In one embodiment, adhesive is used to attach the electrode 292, sub-pad 215, and processing pad 325 together. The adhesive is generally a pressure sensitive adhesive and/or a temperature sensitive adhesive that is compatible with the process chemistry as well as with the different materials used for the electrode 292, sub-pad 215, and the processing pad 325. The adhesive may have a strong physical and/or chemical bond to the electrode 292, sub-pad 215, and the conductive processing pad 325. Selection of the adhesive may also depend upon the form of the electrode 292, sub-pad 215, and conductive processing pad 325. The adhesive bonding between the electrode 292, sub-pad 215, and conductive processing pad 325 may be increased by the surface morphology of the materials selected to form the pad assembly 322 i.e., fabrics, screens, and perforations versus solids. For example, if the electrode 292 is fabricated from a screen, mesh, or perforated foil, a weaker adhesive may be selected due to the increased surface area of the electrode 292. It is also contemplated that stainless steel hook and loop or Velcro® fastener made of stainless steel may be used as the binder between the electrode 292 and the sub-pad 215.

Figure 4:
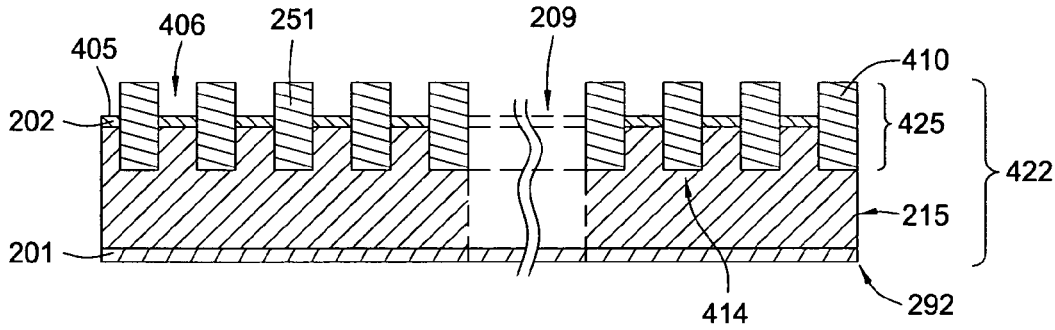
FIG. 4 is a partial schematic cross-sectional view of a process pad assembly depicting another embodiment of a pad body.

FIG. 4 is a partial schematic cross-sectional view of another embodiment of a pad assembly 422 that is similar to the pad assembly 322 shown in FIG. 3. The pad assembly 422 differs from the previous embodiment in that the conductive processing pad 425 has a patterned surface above and below the conductive carrier 405. The patterned surface below the conductive carrier 405 includes a plurality of lower features 414 extending into the sub-pad 215. The raised features 410 on the upper surface of the conductive carrier 405 define a plurality of grooves 406 therebetween, while the lower features 414 add mechanical integrity to the pad assembly 422 and create additional surface area for an adhesive bond between the sub-pad 215 and the processing pad 425. The raised features 410 and the lower features 414 may be formed as one piece through holes in the conductive carrier 405. The processing pad 425 may be attached to the sub-pad 215 via an adhesive after compressing the processing pad 425 onto the sub-pad 215. When the conductive carrier 405 is made of a mesh material, the lower features 414 extending through the conductive carrier 405 may be formed by compressing the conductive composite material 251 through the mesh material and forming the lower features before or after curing of the conductive composite material 251. The conductive processing pad 425 may then be attached to the sub-pad 215 by an adhesive. Alternatively, the raised features 410 and the lower features 414 may be formed by depositing a conductive composite 251 on the upper surface and the lower surface of the conductive carrier 405 and forming the raised features 410 and the lower features 414 before or after curing. The conductive processing pad 425 is then attached to the sub-pad 215 via an adhesive.

Figure 5:
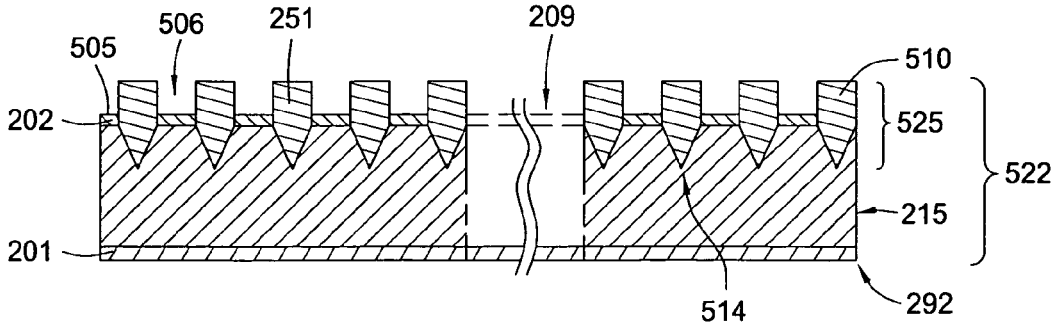
FIG. 5 is a partial schematic cross-sectional view of a process pad assembly depicting another embodiment of a pad body.

FIG. 5 is a partial schematic cross-sectional view of another embodiment of a pad assembly 522 similar to the pad assembly 422 shown in FIG. 4. The pad assembly 522 differs in that the lower features 514 are chambered to aid in compressing the conductive processing pad 525 onto the sub-pad 215 and to provide additional surface area for an adhesive bond to the sub-pad 215.

Figure 6:
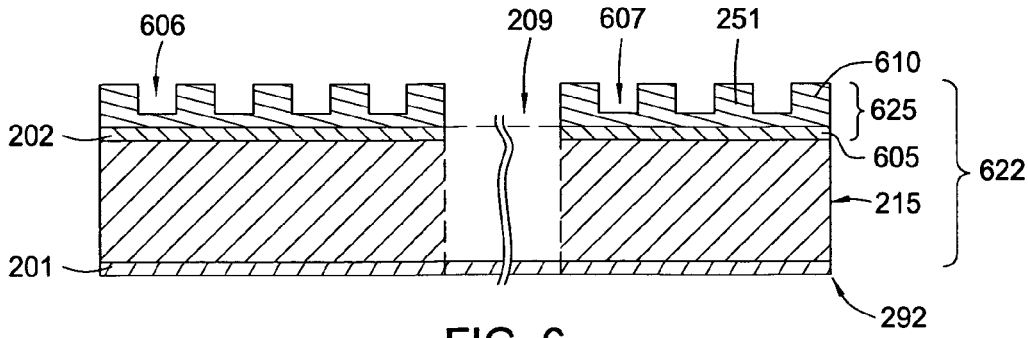
FIG. 6 is a partial schematic cross-sectional view of a process pad assembly depicting another embodiment of a pad body.

FIG. 6 shows a partial schematic cross-sectional view of another embodiment of a pad assembly 622 that is similar to the pad assembly 322 of FIG. 3 except that the conductive composite material 251 is patterned to define channels 606 which include a base of the conductive composite material. The base 607 enables continuous conductive composite material to be formed on the upper surface of the conductive carrier 605. The exposure of the conductive carrier 605 to process chemistry is prevented or at least minimized. It is contemplated that the base 607 will promote longer pad life by limiting exposure of the materials which comprise the conductive carrier 605.

Figure 7:
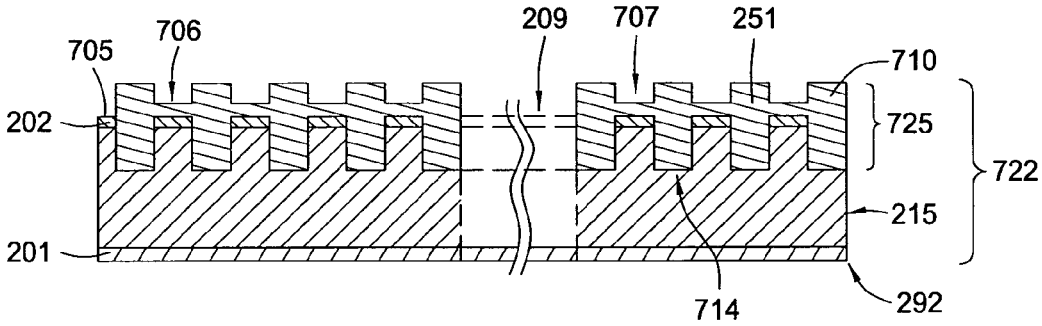
FIG. 7 is a partial schematic cross-sectional view of a process pad assembly depicting another embodiment of a pad body.

FIG. 7 is a partial schematic cross-sectional view of another embodiment of a pad assembly 722 similar to the pad assembly 422 shown in FIG. 4. In this embodiment, when the conductive carrier 705 is formed of tin or copper, the channels 706 may include a base 707 that is made of the conductive composite material 251 forming the raised features 710, thus substantially limiting exposure of the conductive carrier 705 to process chemistry. It is contemplated that the base 707 will promote longer pad life by limiting exposure of the materials which comprise the conductive carrier 705.

Figure 8:
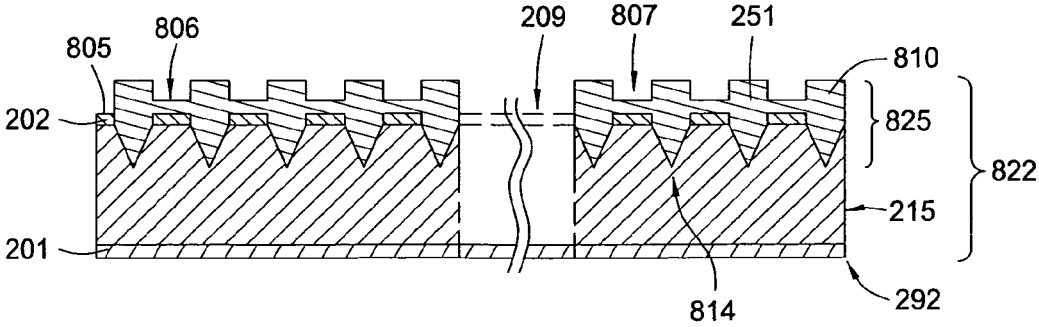
FIG. 8 is a partial schematic cross-sectional view of a process pad assembly depicting another embodiment of a pad body.

FIG. 8 is a partial schematic cross-sectional view of another embodiment of a pad assembly 822 that is similar to the pad assembly 522 shown in FIG. 5. In this embodiment, when the conductive carrier 805 is formed of tin or copper, the channels 806 may include a base 807 that is made of the conductive composite material 251 forming the posts 810, thus substantially limiting exposure of the conductive carrier 805 to process chemistry. It is contemplated that the base 807 will promote longer pad life by limiting exposure of the materials which comprise the conductive carrier 805.

Figure 9:
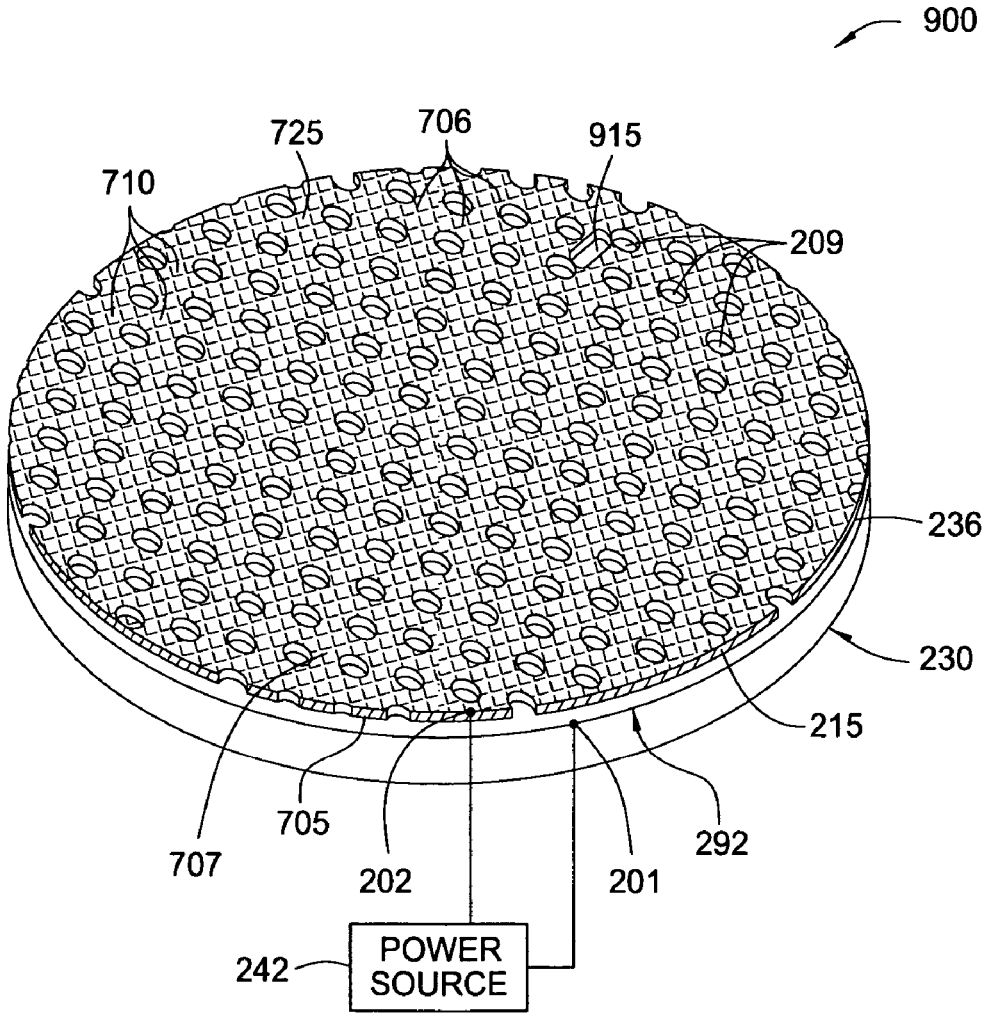
FIG. 9 is an isometric view of one embodiment of a process pad assembly disposed on a platen.

FIG. 9 depicts an isometric view of a pad assembly 900 similar to the pad assembly 722 of FIG. 7. A conductive processing pad 725 defines a plurality of raised features 710 and a plurality of channels 706 on a conductive carrier 705. The pad assembly 900 also includes at least one permeable passage 209, which is shown in the Figure as a plurality of permeable passages that are sized and located for improved electrolyte retention and electrochemical cell enhancement. The conductive processing pad 725 is disposed on a top surface of a platen assembly 230 with an electrode 292 and a sub-pad 215 therebetween. The plurality of raised features 710 extend above the conductive carrier 705. The conductive carrier 705 may be protected from process chemistries by a base 707 as explained above. Alternatively, the plurality of grooves or channels 706 may not have a base 707, thus exposing the conductive carrier 705 to process chemistry. The channels 706 serve as a pathway to aid in transportation and retention of an electrolyte during processing, providing a path for the materials removed from the substrate. The pad assembly 900 may also include a window 915 that is adapted to transmit light from an optical device typically located below the platen assembly 230.

Figure 10:
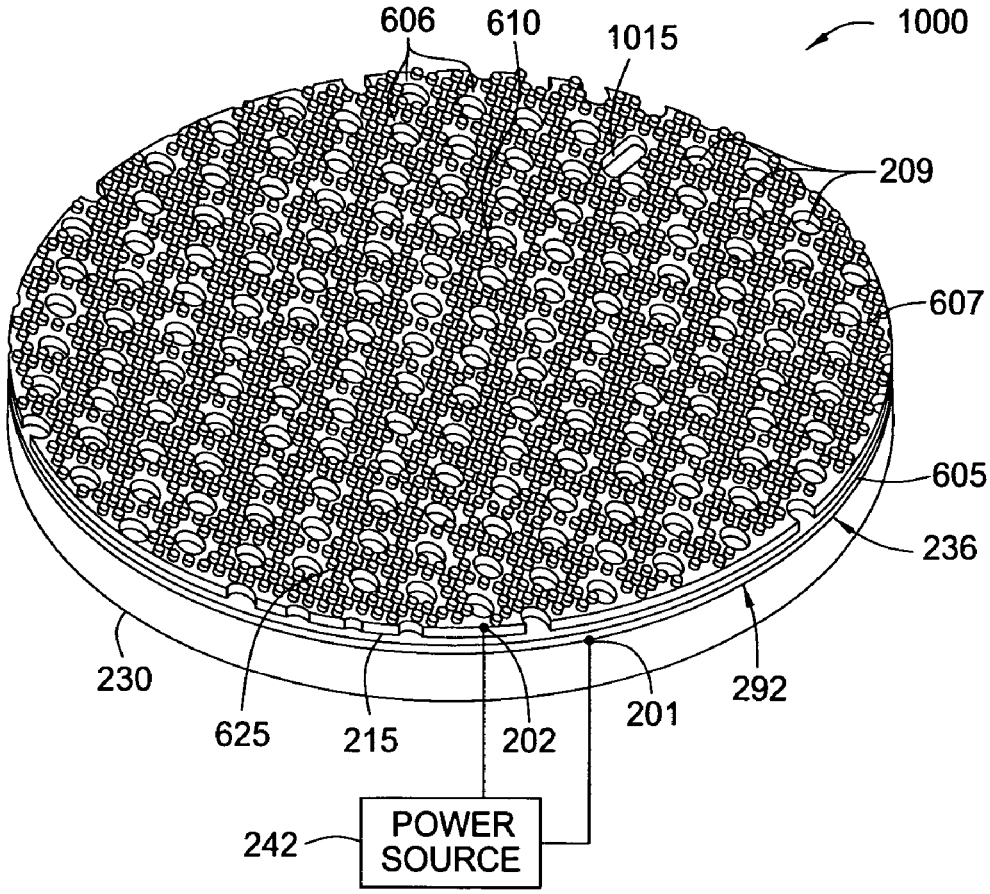
FIG. 10 is an isometric view of another embodiment of a process pad assembly disposed on a platen.

FIG. 10 depicts an isometric view of a pad assembly 1000 similar to the pad assembly 622 of FIG. 6. Shown is a conductive processing pad 625, having a plurality of oval shaped raised features 610 and a plurality of channels 606 on a conductive carrier 605 disposed on a top surface of a platen assembly 230 with an electrode 292 and a sub-pad 215 therebetween. The pad assembly 1000 may also include a window 1015 and a includes at least one permeable passage 209, which is shown in the Figure as a plurality of permeable passages that are sized and located for improved electrolyte retention and electrochemical cell enhancement. The window 1015 is adapted to transmit light from an optical device typically located below the platen 230. The conductive processing pad 625 may have a plurality of raised features 610 extending through the conductive carrier 605. The conductive carrier 605 may be protected from process chemistries by a base 607 as discussed above. Alternatively, the plurality of grooves or channels 606 may not have a base 607, thus exposing the conductive carrier 605 to process chemistry. The channels 606 serve as a pathway to aid in transportation and retention of an electrolyte during processing, providing a path for the materials removed from the substrate.

Figure 11:
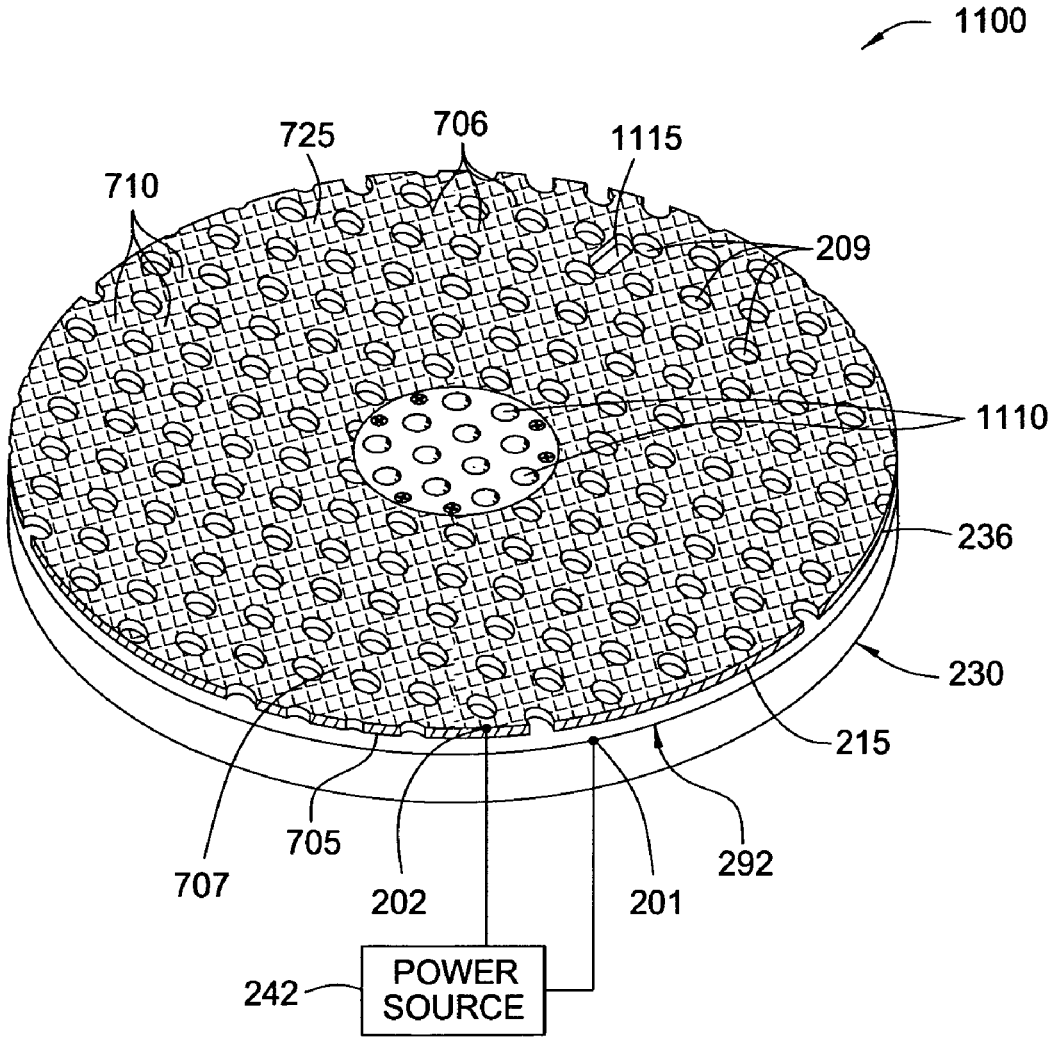
FIG. 11 is an isometric view of another embodiment of a process pad assembly disposed on a platen.

FIG. 11 is an isometric view of a pad assembly 1100 similar to the pad assembly 900 of FIG. 9. In this embodiment, the pad assembly defines a center open portion through which a circular disc containing conductive contact elements 1110 may be disposed. The conductive contact elements 1110 may be substantially planar with the upper surface of the conductive processing pad 725, or extend slightly above the conductive processing pad 725. Examples of conductive contact elements and pad configurations that may be adapted to benefit from aspects of the invention are described in United States Patent Publication No. 2004/0082289, filed Aug. 15, 2003, entitled "Conductive Polishing Article for Electrochemical Mechanical Polishing" previously incorporated by reference, and United States Patent Publication No. 2004/0020789, filed Jun. 6, 2003, under the same title, which is hereby incorporated herein by reference. A detailed description of process pad assemblies relating to conductive contact elements and counterparts can be found in the description of the Figures in United States Patent Publication No. 2004/0163946, previously incorporated by reference.

Processing Pad Manufacture

A method of manufacturing the pad assembly depicted in FIG. 3 will now be described. First, an uncured conductive composite material is deposited on a first surface of a conductive carrier 305 and adhered or joined in a manner that electrically bonds the conductive composite to the conductive carrier 305. Next, the raised features 310 may be formed by compressing a first perforated metal plate having holes that define the raised features 310 onto the conductive composite material before the conductive composite has cured. The first plate may be compressed down to the conductive carrier 305 as shown in FIG. 3, or spaced a preferred distance from the conductive carrier 305 to form the base 607 as shown in FIG. 6. Excess conductive composite material compressed through the holes on the first surface may then be removed by a conventional process or an alternative process where two plates are stacked onto one another. In the case where two plates are used, an upper plate placed equally and compressed on the first plate may then be slid or twisted under pressure to allow the holes in the first and second plate to act as cutting edges for the excess composite, thereby creating raised features 310 of a uniform height within the holes of the first plate. After the composite has cured, the first plate may then be removed, thereby creating the conductive processing pad 325 that may now be adhesively bound to the sub-pad 215 disposed on the opposing conductive layer or electrode 392.

The perforated metal plate may have hole shapes that define the raised features that include ovals and polygons such as substantial rectangles, and have a center to center spacing in the range from about 0.026 inches to about 0.160 inches, for example, about 0.080 inches. The perforated metal plate may also have a thickness, that defines the height of the raised features, in the range of about 0.008 inches to about 0.020 inches, for example, about 0.015 inches. Hole sizes, in the case of ovals, range in diameter from about 0.016 inches to about 0.140 inches, for example, about 0.06 inches. Hole sizes in the case of substantial rectangles have at least one side dimensioned in a range from about 0.016 inches to about 0.140 inches, for example, about 0.06 inches. Additionally, the perforated metal plate may be coated with a polymer compound, such as a Teflon® coating, to ease removal of the plate from the cured composite.

In the embodiment shown in FIG. 4, the raised features 410 and lower features 414 are formed through the conductive carrier 405. The process may employ up to 4 equal plates instead of one or two as described above. In this embodiment, an uncured conductive composite material may be formed on a first surface and an opposing second surface of, or through, a conductive carrier 405. A first perforated metal plate having holes that define the raised features 410 onto the conductive composite material before the conductive composite has cured. The first plate may be compressed down to the conductive carrier 405 as shown in FIG. 4, or spaced a preferred distance from the conductive carrier 405 to form the base 707 as shown in FIG. 7. Excess conductive composite material compressed through the holes on the first surface may then be removed by a conventional process or an alternative process where two plates are stacked onto one another. The opposing second surface may be formed from one or two plates each as described above to form lower features 414 that are uniform on the second surface. The first surface of the conductive carrier 405 with the conductive composite thereon is adapted to contact the substrate (after forming into raised features 410) while the opposing second surface of the conductive carrier 405 with the conductive composite thereon is to be compressed and adhesively bound to the sub-pad 215. The resulting conductive processing pad 425 is similar to the embodiment depicted in FIG. 4.

In the embodiment depicted in FIG. 5 which is similar in construction to the embodiment depicted in FIG. 8, the process may require one plate or two equal plates to form the upper surface of the conductive carrier 505 with the conductive composite thereon by the process described above. The opposing second surface may employ a plate that has equal spacing and hole sizes, but the holes taper from the greatest dimension down to create the chamber on the lower features 514. The holes may taper from the greatest dimension down to zero within the thickness range of the plate, or taper to some dimension that allows some of the conductive composite to flow through the perforated plate during compression that may be removed after curing. The resulting conductive processing pad 525 may then be compressed onto a sub-pad 215 disposed on an electrode 292 and bound by adhesives.

While the foregoing is directed to embodiments of the present invention, other and further embodiments of the invention may be devised without departing from the basic scope thereof, and the scope thereof is determined by the claims that follow.

The invention claimed is:

1. A pad assembly for processing a substrate, comprising:
a conductive carrier;
a plurality of raised features comprising a conductive composite extending from the conductive carrier, the raised features defining a plurality of grooves on the conductive carrier;
a plurality of lower features extending from the conductive carrier;
a sub-pad adhered to the conductive carrier and
an opposing conductive layer adhered to the sub-pad.

2. The pad assembly of claim 1, wherein the conductive composite comprises a conductive polishing material.

3. The pad assembly of claim 2, wherein the conductive polishing material comprises a conductive element disposed in a polymer matrix.

4. The pad assembly of claim 3, wherein the conductive element is a tin material.

5. The pad assembly of claim 1, wherein the opposing conductive layer is bound to a platen assembly.

6. The pad assembly of claim 1, wherein the conductive carrier comprises a tin material.

7. The pad assembly of claim 1, wherein the conductive carrier further comprises:
a terminal in communication with a power source.

8. The pad assembly of claim 1, wherein the opposing conductive layer further comprises a terminal in communication with a power source.

9. A conductive pad for processing a substrate, comprising:
a conductive carrier; and
a plurality of conductive features extending from the conductive carrier, defining a plurality of grooves therebetween, wherein the conductive features are above and below the conductive carrier.

10. The pad assembly of claim 9, wherein the conductive carrier is adhered to a sub-pad and the sub-pad is adhered to an opposing conductive layer.

11. The pad assembly of claim 10, wherein the opposing conductive layer is bound to a platen assembly.

12. The pad assembly of claim 10, wherein the opposing conductive layer further comprises a terminal in communication with a power source.

13. The pad assembly of claim 9, wherein the conductive features comprise a conductive composite.

14. The pad assembly of claim 13, wherein the conductive composite comprises conductive elements disposed in a polymer matrix.

15. The pad assembly of claim 14, wherein the conductive elements are a tin material.

16. The pad assembly of claim 9, wherein the conductive carrier comprises a tin material.

17. The pad assembly of claim 9, wherein the conductive carrier further comprises a terminal in communication with a power source.

* * * * *

UNITED STATES PATENT AND TRADEMARK OFFICE

CERTIFICATE OF CORRECTION

PATENT NO. : 7,427,340 B2
APPLICATION NO. : 11/102557
DATED : September 23, 2008
INVENTOR(S) : Mavliev et al.

It is certified that error appears in the above-identified patent and that said Letters Patent is hereby corrected as shown below:

Title Page

In the References Cited (56):
Please delete "2,457,510 A 12/1948 van Omum" and insert --2,457,510 A 12/1948 Van Ornum-- therefor;
Please delete "2,708,175 A 5/1955 Manson et al." and insert --2,708,445 A 5/1955 Manson et al.-- therefor;
Please delete "2,710,834 A 6/1955 Vritakas" and insert --2,710,834 A 6/1955 Vrilakas-- therefor;

In the Summary of the Invention:
Column 2, Line 33, please delete "chambered" and insert --chamfered-- therefor;

In the Detailed Description:
Column 6, Line 47, please delete "1 15" and insert --115-- therefor;
Column 9, Line 12, please delete "chambered" and insert --chamfered-- therefor;
Column 11, Line 55, please delete "chamber" and insert --chamfer-- therefor.

Signed and Sealed this

Sixth Day of January, 2009

JON W. DUDAS
*Director of the United States Patent and Trademark Office*